US005845361A

United States Patent [19]

Murakami et al.

[11] Patent Number: 5,845,361

[45] Date of Patent: Dec. 8, 1998

[54] SWEEPER DEVICE

[75] Inventors: Masaki Murakami, Ehime-ken; Hiroki Ishikawa; Yasuhiko Kenmochi, both of Kagawa-ken, all of Japan

[73] Assignee: UNI-Charm Corporation, Ehime-ken, Japan

[21] Appl. No.: 768,443

[22] Filed: Dec. 18, 1996

[30] Foreign Application Priority Data

Dec. 28, 1995 [JP] Japan ..... 7-343690

[51] Int. Cl.[6] ..... A47L 13/46

[52] U.S. Cl. ..... 15/231; 15/228

[58] Field of Search ..... 15/114, 115, 118, 15/147.1, 228, 231, 232, 233, 247

[56] References Cited

U.S. PATENT DOCUMENTS 5,426,809 6/1995 Muta ..... 15/231

FOREIGN PATENT DOCUMENTS

Hei 6-78872 3/1994 Japan .

*Primary Examiner*—Terrence Till

*Attorney, Agent, or Firm*—Lowe Hauptman Gopstein Gilman & Berner

[57] ABSTRACT

A sweeper device includes a rectangular head, a stick mounted on an upper surface of the head and a sweeping sheet detachably attached to cover a lower surface of the head. The head is provided along at least a pair of side walls extending transversely thereof with elastic side walls so that a sweeping sheet can be attached onto a bottom of the head in a tension state.

5 Claims, 4 Drawing Sheets

SWEEPER DEVICE

BACKGROUND OF THE INVENTION

The present invention relates to a sweeper device and, more particularly, to a sweeper device such as a broom adapted to be detachably equipped with a sweeping sheet and used to sweep a house floor or the like.

The sweeper device of the above type is known, for example, from Japanese Laid-Open Patent Application No. Hei6-78872. This sweeper device comprises a rectangular head detachably carrying a sweeping sheet and a stick pivotally coupled to a top side of the rectangular head. The head has long sides extending transversely relative to the direction of sweeping and is provided on a top side thereof with left and right clamp means for clamping the sweeping sheet to the top side and on a bottom side thereof with a plurality of elastic projections extending down vertically thereof. The sweeping sheet covers the bottom side of the head and marginal regions thereof extending outward beyond a peripheral edge of the head are folded back onto the top side of the head and clamped thereto by the clamp means.

It is preferred that the sweeping sheet be tightly attached to the head. Attachment of the sweeping sheet to the head in such a manner will allow even a slight movement of the head on the floor in all directions to be followed by the sweeping sheet and thus every spot on the floor to be cleaned can be reliably sweeped. Otherwise, the sweeping sheet may hardly move even if the head is moved so far as the movement is slight and it will be impossible to sweep the floor reliably. With the known cleaner device, the bottom projections are slightly crooked and thereby elastically deformed during attachment of the sweeping sheet to the head so that, after having been attached to the head, the sweeping sheet can be tensioned on the bottom surface of the head and thereby kept in tight contact with the bottom surface. To achieve this effect, however, the sweeping sheet must be sufficiently stout to the elastic restoration of the bottom projections which tends to pierce the sweeping sheet and this requirement may increase the cost of the sweeping sheet.

SUMMARY OF THE INVENTION

In view of the problem as described above, it is a principal object of the invention to provide an improved sweeper device allowing a sweeping sheet to be tightly attached to a head of a sweeper device even if the sweeping sheet is not noticeably stout.

The object set forth above is achieved, according to the invention, by a sweeper device comprising a rectangular head defined by a pair of first side walls extending transversely thereof and a pair of second side walls connecting the first side walls, a stick mounted on an upper side of the head and a sweeping sheet detachably attached to the head to cover a bottom side of the head, wherein the head includes elastic third side walls extending along and outside at least the first side walls; and each of the third side walls comprises an inner section substantially fixed to the first side wall and an outer section connected to the inner section and spaced outward from the first side wall by a predetermined distance.

DESCRIPTION OF THE PREFERRED EMBODIMENT

Figure 1:
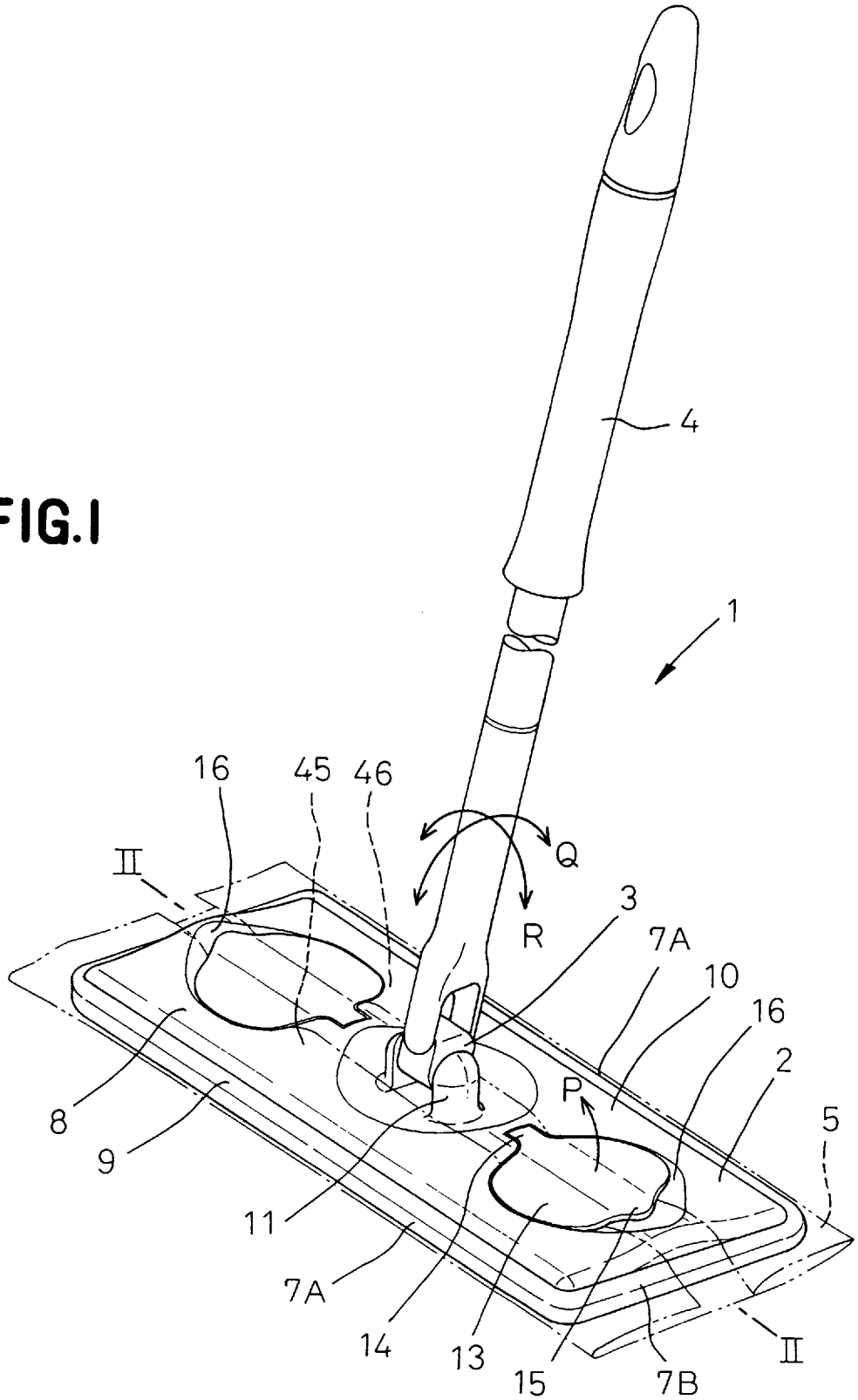
FIG. 1 is a perspective view showing a sweeper device according to the invention.

A sweeper device 1 shown by FIG. 1 in a perspective view comprises a plate-like head, a stick 4 connected by a universal joint 3 to the head, and a sweeping sheet 5 attached to the head 2 as shown by imaginary lines. The sweeping sheet 5 is made of nonwoven fabric or the like.

The head 4 is a rectangle defined by a pair of long sides 7A extending transversely with respect to the direction; of sweeping and a pair of short sides 7B connecting the long sides 7A. The head 2 comprises a main body 8 made of hard plastic material and an elastic plate member 9 made of soft elastic material such as plastic and rubber covering a peripheral wall 21 (FIG. 2) of the main body 8. An upper surface 10 of the main body 8 is centrally provided with a pair of projections 11 for mounting of the universal joint 3 and provided on transversely opposite sides of the main body 8 with recesses 16, respectively. Referring to FIG. 1, the respective recesses 16 have substantially entire areas thereof covered with respective sheet clamping members 13 which are pivotable around inner ends 14 of the clamping member 13 relative to the main body 8. The clamping members 13 may be opened or closed relative to the associated recesses 16 by grasping outer ends 15. After these sheet clamping members 13 have been opened in the direction as indicated by an arrow P, a marginal portion of the sheet 5 may be folded onto the upper surface 10 of the main body 8 followed by closing of the clamping members 13 to hold the sheet 5 between the upper surface 10 and the respective members 13 in an unremoved state of the sweeping sheet 5.

The stick 4 is made of hard plastic material and pivotable in two directions as indicated by double-headed arrows Q and R.

Figure 2:
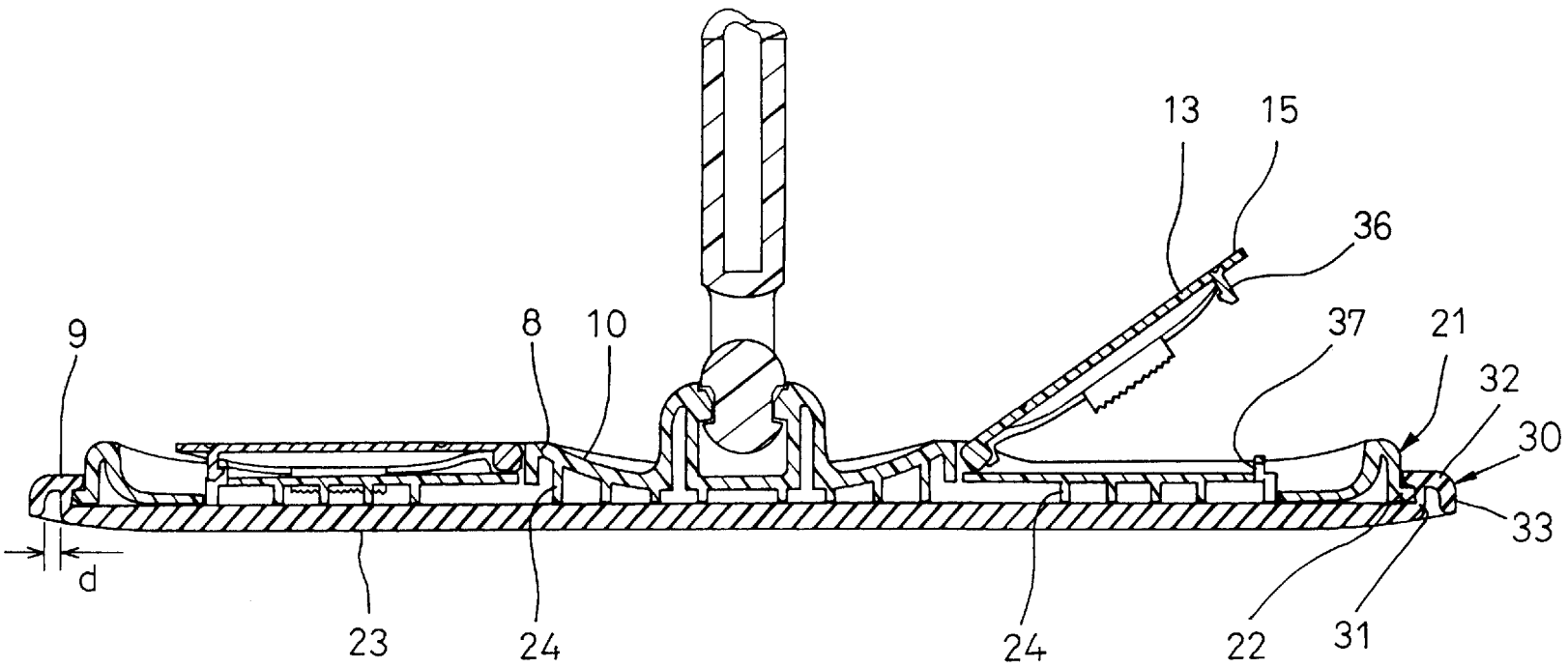
FIG. 2 is a sectional view taken along line II—II in FIG. 1.

FIG. 2 is a sectional view taken along line II—II in FIG. 1 and shows one of the clamping members 13 in an opened state. In the head 2, the elastic plate member 9 has an inner peripheral side wall 31 tightly engaged with a flange 22 formed along a peripheral wall 21 of the main body 8 so that the peripheral wall 21 and the inner peripheral side wall 31 are substantially integral with each other. The elastic plate member 9 completely covers a lower side of the main body 8 and thereby forms a lower surface 23 of the head 2. A plurality of ribs 24 project downward from the lower side of the main body 8 and bear against an inner surface of the elastic plate member 9 from above. The elastic plate member 9 includes, in addition to the inner peripheral side wall 31, an outer peripheral side wall 30 having a generally inverted L-shaped cross-section extending outside the inner peripheral side wall 31. The side wall 30 comprises an inner section 32 extending outward from an upper end of the side wall 31 and an outer section 33 extending outward from the inner section 32 and then extending downward so that the outer section 33 is spaced apart outward from the side wall 31 by a predetermined distance d.

Figure 3:
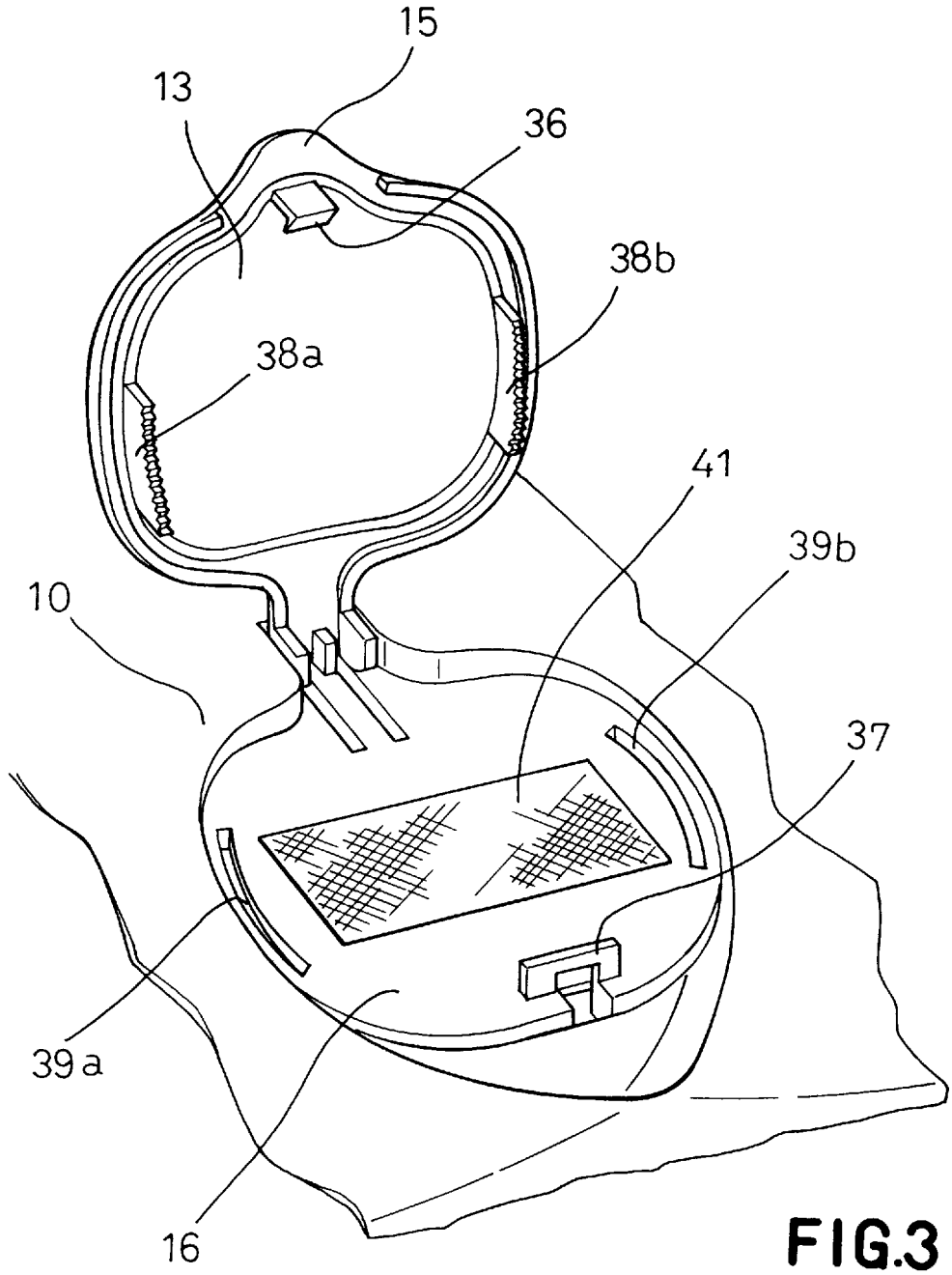
FIG. 3 is a fragmentary perspective view showing a head as a clamping member being in opened state.

FIG. 3 is a fragmentary perspective view showing the head 2, in which the clamping member 13 is in opened state. The clamping member 13 is made of hard plastic material and includes a locking jaw 36 formed on a lower surface of the outer end 15. The locking jaw 36 is adopted to be engaged with a locking jaw 37 formed on the main body 8 in a latch fashion as the clamping member 13 is closed. The lower surface of the clamping member 13 is formed an transversely opposite sides thereof with a pair of locking means 38*a*, 38*b* extending downward and having their forward ends in the form of sawteeth. These locking means 38*a*, 38*b* are firmly inserted into a pair of slots 39*a*, 39*b* formed in the upper surface 10 of the main body 8 as the clamping member 13 is closed. A hook tape 41 constituting one component of paired mechanical fastening tapes known under the trade mark VELCRO is affixed to the main body 8 between the slots 39*a*, 39*b*.

Operation of the device 1 constructed as described above begins with opening the clamping members 13. Then, the sweeping sheet 5 is put over the lower surface 23 of the head 2 and transversely opposite marginal portions 45, 46 of the sweeping sheet 5 (FIG. 1) are folded onto the upper surface 10 of the head 2 so that the marginal portion 45 may cover the slots 39*a* and the marginal portion 46 may cover the slots 39*b*. These marginal portions 45, 46 are fastened to the hook tape 41. Then the clamping members 13 are closed to hold the sweeping sheet 5 between side walls of the locking means 38*a*, 38*b* and side walls of the slots 39*a*, 39*b*. Simultaneously, the sweeping sheet 5 is engaged with the sawtoothed forward ends of the locking means 38*a*, 38*b*. Such double fastening effect ensures that the sweeping sheet 5 is never removed from the head 2 during operation of cleaning the floor. The presence of the elastic side wall 30 surrounding the head 2 is particularly effective in that the side wall 30 is elastically deformed and then tends to restore its initial position as the marginal portions 45, 46 are fastened to the hook tape 41 and the clamping members 13 are closed so as to tension the sweeping sheet 5. Restoration of the outer side wall 30 causes the sweeping sheet 5 to be further tensioned and thereby to be tightly held on the lower surface 23 of the head 2.

Figure 4:
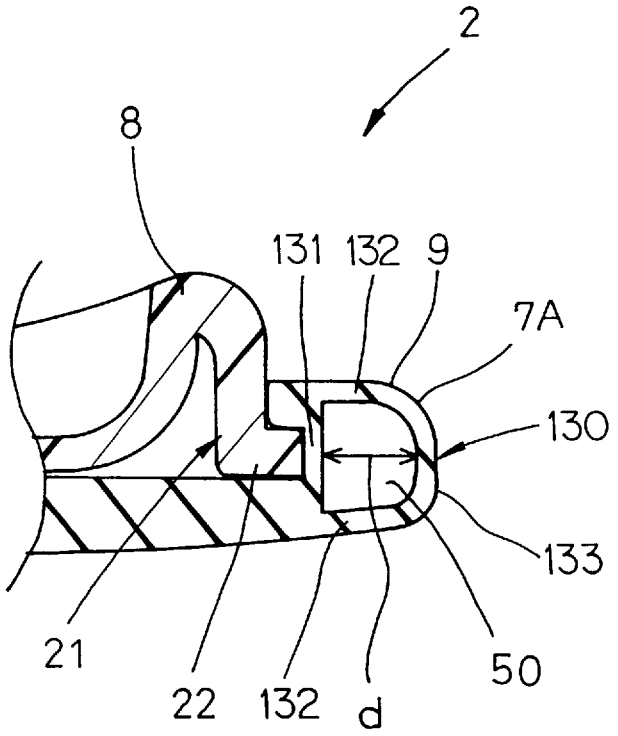
FIG. 4 is a fragmentary sectional view showing, in an enlarged scale, a specific embodiment of the invention.

FIG. 4 is a fragmentary sectional view showing, in an enlarged scale, a specific embodiment of the head 2 according to the invention. An elastic side wall 130 defined by the elastic plate member 9 comprises inner sections 132 extending outward from upper and lower ends of the inner side wall 131 substantially integral with the main body 8 and the outer section 133 connecting the inner sections 132 so as to present a convex cross-sectional shape. The outer section 133 is spaced apart outside from the side wall 131 by a predetermined distance d and a cavity 50 is defined between the side wall 131 and the outer section 133. The side wall 130 has a generally D-shaped cross section. The outer side wall 130 is elastically deformed inward as the sweeping sheet 5 is attached to the head 2 and the restoration of the outer side wall 130 causes the sheet 5 to be reliably tensioned.

With the sweeper device of the invention, the desired effect will be obtained by forming the elastically deformable side wall 130 only along the long sides 7A of the head 2 along which the sweeping sheet 5 is folded back. However, it is preferred to form the side wall 130 along the entire periphery of the head 2 as illustrated, because the side wall 130 has also a damping effect and protects pieces of furniture or the like from being damaged even when the head 2 strikes them. The outer side wall 130 is readily deformed as it is forced by the sweeping sheet 5 since the outer section 133 is spaced apart outward from the side wall 131 by a predetermined distance d. Particularly when various dimensions such as a thickness of the outer section 133 are selected depending on an elasticity of the plate member 9, the optimal restoration to tension the sweeping sheet 5 can be easily obtained.

In the sweeper device according to the invention, the head 2 to which the sweeping sheet 5 is attached is provided along at least one pair of parallel sides extending transversely of the head 2 with the elastically deformable side walls 130 each comprising the inner section(s) 32, 132 fixed to the side wall 21 of the head 2 and the outer section 133 spaced outward from the inner section(s) 32, 132. This unique arrangement is advantageous for tightly holding the sweeping sheet 5 on the lower surface 23 of the head 2, since the side wall 30, 130 is readily deformed and then tends to restore its initial position as the sweeping sheet 5 is attached to the head 2. Restoration of the side wall 30, 130 causes the sweeping sheet 5 to be further tension and thereby to be further tightly held on the lower surface 23 of the head 2.

What is claimed is:

1. A sweeper device comprising a generally rectangular head defined by a pair of first side walls extending transversely thereof and a pair of second side walls connecting the first side walls, a stick mounted on an upper surface of the head and a sweeping sheet detachably attached to the head to cover a bottom side of the head, wherein:

the head comprises elastic third side walls extending along and outside at least the first side walls; and each of the third side walls comprises an inner section substantially fixed to the associated first side wall and an outer section connected to the inner section and spaced apart outward from the first side wall by a predetermined distance.

2. A sweeper device according to claim 1, wherein each of the third side walls has a generally inverted L-shaped cross section extending downward.

3. A sweeper device according to claim 1, wherein each of the third side walls has a generally D-shaped cross section.

4. A sweeper device according to claim 1, wherein the third walls are formed integrally with a generally rectangular elastic plate member covering a bottom of the head with the third walls formed along transverse side edges of the elastic plate member.

5. A sweeper device according to claim 1, wherein the head comprises a main body made of hard plastic material and the elastic plate member made of one of soft plastic and rubber.

* * * * *